US010920542B2

(12) United States Patent
Robey et al.

(10) Patent No.: US 10,920,542 B2
(45) Date of Patent: Feb. 16, 2021

(54) PERFORATOR HAVING MOVABLE CLUSTERS OF PERFORATOR GUNS

(71) Applicant: Halliburton Energy Services, Inc., Houston, TX (US)

(72) Inventors: Richard Ellis Robey, Mansfield, TX (US); Christopher C. Hoelscher, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 68 days.

(21) Appl. No.: 16/348,900

(22) PCT Filed: Feb. 3, 2017

(86) PCT No.: PCT/US2017/016570

§ 371 (c)(1),
(2) Date: May 10, 2019

(87) PCT Pub. No.: WO2018/144021

PCT Pub. Date: Aug. 9, 2018

(65) Prior Publication Data

US 2019/0271214 A1 Sep. 5, 2019

(51) Int. Cl.
*E21B 43/117* (2006.01)

(52) U.S. Cl.
CPC ..... *E21B 43/117* (2013.01)

(58) Field of Classification Search
CPC .... E21B 43/116; E21B 46/117; E21B 43/118; E21B 43/119
See application file for complete search history.

(56) References Cited

U.S. PATENT DOCUMENTS 2,664,158 A * 12/1953 McKean ..... E21B 43/118 175/4.53
2,690,123 A * 9/1954 Kanady ..... E21B 43/117 175/4.52
2010/0012312 A1 1/2010 Ochoa
2011/0094745 A1 4/2011 Frazier et al.
2013/0255950 A1 10/2013 Richards
2015/0176406 A1 6/2015 Corre et al.

FOREIGN PATENT DOCUMENTS

AL 1780373 5/2007

OTHER PUBLICATIONS

PCT Application No. PCT/US2017/016570, International Search Report, dated Oct. 18, 2017, 3 pages.
PCT Application No. PCT/US2017/016570, International Written Opinion, dated Oct. 18, 2017, 11 pages.

* cited by examiner

*Primary Examiner* — Giovanna Wright
(74) *Attorney, Agent, or Firm* — Gilliam IP PLLC

(57) ABSTRACT

An apparatus comprises a first cluster of perforator guns positioned circumferentially around a central longitudinal axis at a first axial position. The apparatus includes a second cluster of perforator guns positioned circumferentially around the central longitudinal axis at a second axial position. The first and second clusters are configured in a closed position while the apparatus is being lowered to a perforator position in a wellbore. After the apparatus is lowered to the perforator position, the first and second clusters are to move to an expanded position and the first cluster is to move axially such that the first cluster and the second cluster at least partially overlap.

20 Claims, 9 Drawing Sheets

PERFORATOR HAVING MOVABLE CLUSTERS OF PERFORATOR GUNS

BACKGROUND

The disclosure generally relates to the field hydrocarbon production, and more particularly to perforating wellbores.

During hydrocarbon production, selective establishment of fluid communication can be created between the interior of a tubular string, such as a casing, liner, tubing, or the like, and the annulus surrounding the tubular string. Communication can be established by creating one or more tubular perforations. Typically, high-explosive, shaped charges can be used to create the perforations. The shaped charges can be detonated at a selected location downhole, often creating a jet of hydrodynamically formed material which penetrates the tubular string, thereby forming an opening.

BRIEF DESCRIPTION OF THE DRAWINGS

Embodiments of the disclosure may be better understood by referencing the accompanying drawings.

DESCRIPTION

Figure 1:
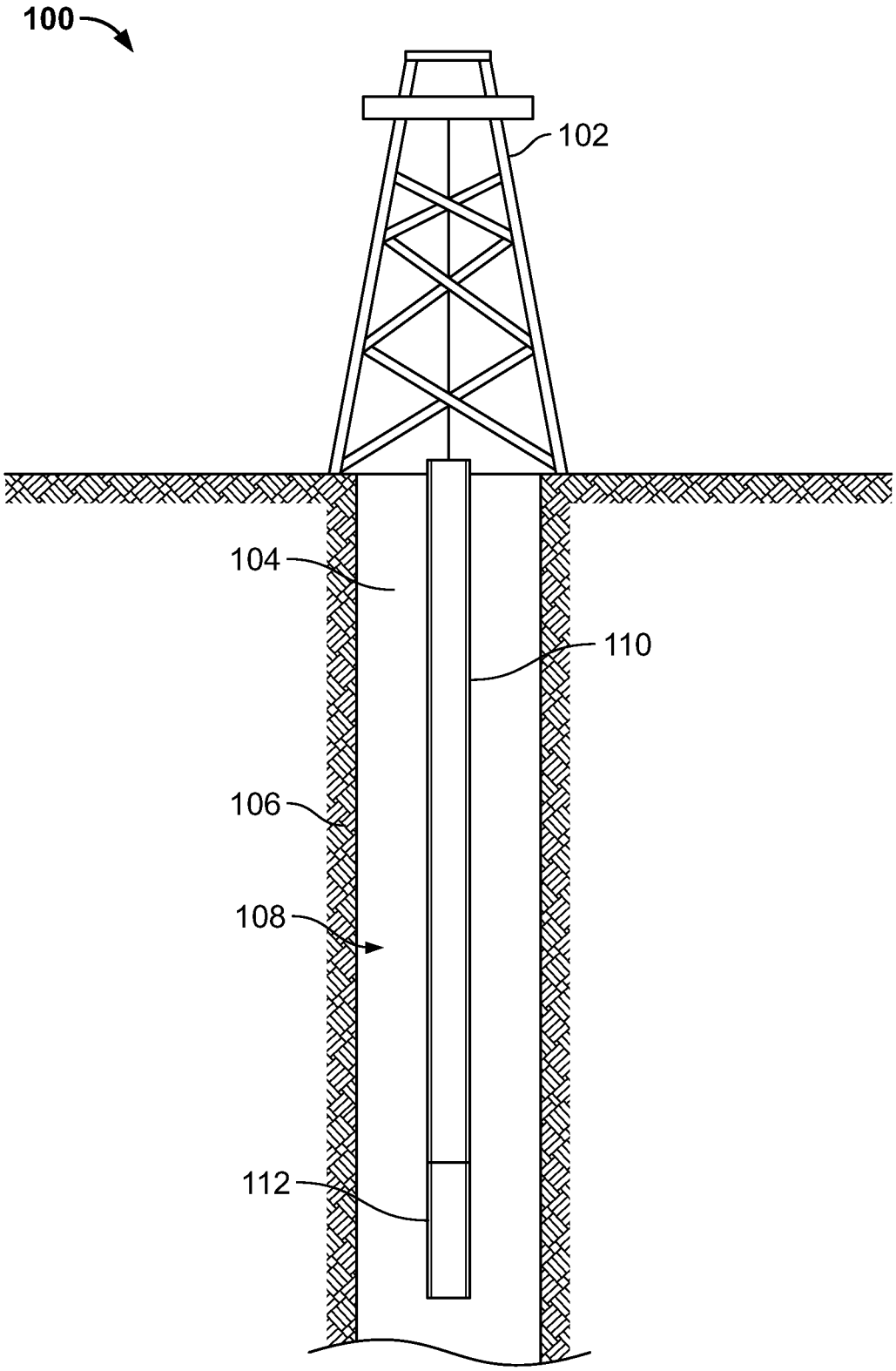
FIG. 1 depicts an example system that includes a perforator tool, according to some embodiments.

The description that follows includes example systems, apparatuses, and methods that embody aspects of the disclosure. However, it is understood that this disclosure may be practiced without these specific details. For instance, this disclosure refers to perforations of wellbores for hydrocarbon production in illustrative examples. Aspects of this disclosure can be also applied to any other perforating applications. In other instances, well-known instruction instances, structures and techniques have not been shown in detail in order not to obfuscate the description.

Various embodiments include perforator tools to perforate wellbores as part of hydrocarbon production and recovery. For example, a perforator tool, according to some embodiments, can be used in a wellbore to create holes in casings or other tubulars to provide a path for fluid flow. Alternatively or in addition, such a perforator tool can also be used to penetrate a formation surrounding a wellbore. Some embodiments provide for increased explosive packaging, lowered fluid gaps, and high flow areas. Example downhole applications that can leverage these features include perforating for abandonment of a well, wellbore restrictions above the perforating, and laminated reservoirs. For example, extremely high flow areas in casing can be needed for a wash and cementing process before abandoning a well.

In some embodiments, a perforator tool can include a first cluster of perforator guns at a first axial position and in a closed position about a central member or sleeve. The perforator tool can include a second cluster of perforator guns at a second axial position and in the closed position about the central member or sleeve. The first and clusters of perforator guns can remain in the closed position until the perforator tool is lowered to a perforator position downhole where perforating is to occur. For instance, in the closed position, a diameter of the first and second clusters can be at a minimum. In the closed position, the first cluster of perforator guns can be arranged such that guns are in tangent contact. Similarly, in the closed position, the second cluster of perforator guns can be arranged such that guns are in tangent contact.

After the perforator tool is at a position downhole where perforating is to occur, the first and second clusters of perforator guns can be expanded out from the central member to an expanded position at a second radial position. For instance, the first and second clusters of perforator guns can be expanded to a second radial position to be in contact with the casing or formation. The first cluster can then be axially moved such that the first cluster and the second cluster at least partially overlap. In some embodiments, the perforator guns of the first cluster are arranged to be out of phase with the perforator guns of the second cluster. Accordingly, after the first cluster and the second cluster are overlapping, a denser perforator cluster is formed than either of the two clusters separately.

Thus, individual perforator guns can be articulated out towards the perforating target and can allow the individual perforator guns to contact the casing or exposed formation. Additionally, a slim diameter of clusters of perforator guns at different phases can be lowered down the wellbore. These clusters can then be brought together (e.g. at least partial overlapping) to create a large effective diameter perforator tool with high explosive density (low phasing angle between guns).

Example System

FIG. 1 depicts an example system that includes a perforator tool, according to some embodiments. As illustrated in FIG. 1, a wellbore servicing system 100 comprises a servicing rig 102 that extends over and around a wellbore 104 that penetrates a subterranean formation 14. The wellbore 104 may be used to recover hydrocarbons, store hydrocarbons, dispose of various fluids (e.g., recovered water, carbon dioxide, etc.), recover water (e.g., potable water), recover geothermal energy, or the like. The wellbore 104 may be drilled into the subterranean formation 106 using any suitable drilling technique. While shown as extending vertically from the surface in FIG. 1, in some embodiments the wellbore 104 may be horizontal, deviated at any suitable angle, and/or curved over one or more portions of the wellbore 104. The wellbore 104 generally comprises an opening disposed in the earth having a variety of shapes and/or geometries, and the wellbore 104 may be cased, open hole, and/or lined.

The servicing rig 102 may be one of a drilling rig, a completion rig, a workover rig, a servicing rig, or other mast like structure and may support a wellbore tubular string 108 in the wellbore 104. In some embodiments, a different structure may support the wellbore tubular string 108, for example an injector head of a coiled tubing rig. In some embodiments, the servicing rig 102 may comprise a derrick with a rig floor through which the wellbore tubular string 108 extends downward from the servicing rig 102 into the wellbore 104. In some embodiments, such as in an off-shore location, the servicing rig 102 may be supported by piers extending downwards to a seabed. The servicing rig 102 can be supported by columns sitting on hulls and/or pontoons that are ballasted below the water surface, which may be referred to as a semi-submersible platform or rig. In an off-shore location, a casing may extend from the servicing rig 102 to exclude seawater. It should be understood that other conveyance mechanisms may control the run-in and withdrawal of the wellbore tubular string 108 in the wellbore 104, for example draw works coupled to a hoisting apparatus, a slickline unit, a wireline unit (e.g., including a winching apparatus), another servicing vehicle, a coiled tubing unit, and/or any other suitable apparatus.

The wellbore tubular string 108 can comprise any of a variety of wellbore tubulars 110, a perforator tool 112, and optionally, other tools and/or subassemblies located above and/or below the perforator tool 112. The wellbore tubulars 110 may comprise any type of work string or production string, including, but not limited to production string, string of jointed pipes, slickline, electric wire-line, coiled tubing, and other types of conveyances known in the drilling, completing or logging arts for conveying tools such as perforator tool 112 down into a wellbore.

In some embodiments, the perforator tool 112 can comprise two or more clusters of perforator guns (described in more detail below). Each perforator gun can include one or more explosive charges that may be triggered to detonate, perforating a casing, if present, a wall of the wellbore 104, and/or forming perforation tunnels in the subterranean formation 106. Perforating may allow for the recovery of fluids such as hydrocarbons from the subterranean formation 106 for production at the surface, storing fluids (e.g., hydrocarbons, aqueous fluids, etc.) flowed into the subterranean formation 106, and/or disposed on various fluids in the subterranean formation 106.

The perforator tool 112 may comprises a plurality of shaped charges. Generally, explosive charge assemblies utilized as well perforating charges include a generally cylindrical or cup-shaped housing having an open end, within which is mounted a shaped explosive generally configured as a hollow cone having its concave side facing the open end of the housing. The concave surface of the explosive is lined with a thin metal liner which is explosively driven to hydrodynamically form a jet of material with fluid-like properties upon detonation of the explosive. This jet of viscous material exhibits a good penetrating power to pierce the well pipe, its concrete liner and the surrounding earth formation. Typically, the explosive charge assemblies are configured so that the liners along the concave surfaces thereof define simple conical liners with a small radius apex at a radius angle of from about 5 degrees to about 60 degrees. Other charges have an apex with a hemispherical, a half-ellipse, a portion of a parabola, a portion of a hyperbola, a half circle, a cone, a frusto-conical shape, or some other shape fitted with a liner of uniform thickness.

Generally, explosive materials such as HMX, RDX, PYX, or HNS are coated or blended with binders such as wax or synthetic polymeric reactive binders such as that sold under the trademark KEL-F. The resultant mixture is cold- or hot-pressed to approximately 90% of its theoretical maximum density directly into the explosive charge assembly case. The resulting explosive charge assemblies are initiated by means of a booster or priming charge positioned at or near the apex of the explosive charge assembly and located so that a detonating fuse, detonating cord or electrical detonator may be positioned in close proximity to the priming charge.

Explosive charge assemblies may be designed as either deep-penetrating charges or large-diameter hole charges. Generally, explosive charge assemblies designed for use in perforating guns may contain 5 to 60 grams of high explosive and those designed as deep-penetrating charges may typically penetrate concrete from 10 inches to over 50 inches. Large-diameter hole explosive charge assemblies for perforating guns may create holes on the order of about one inch in diameter and display concrete penetration of up to about 9 inches.

Example Perforator Tool

Figure 2:
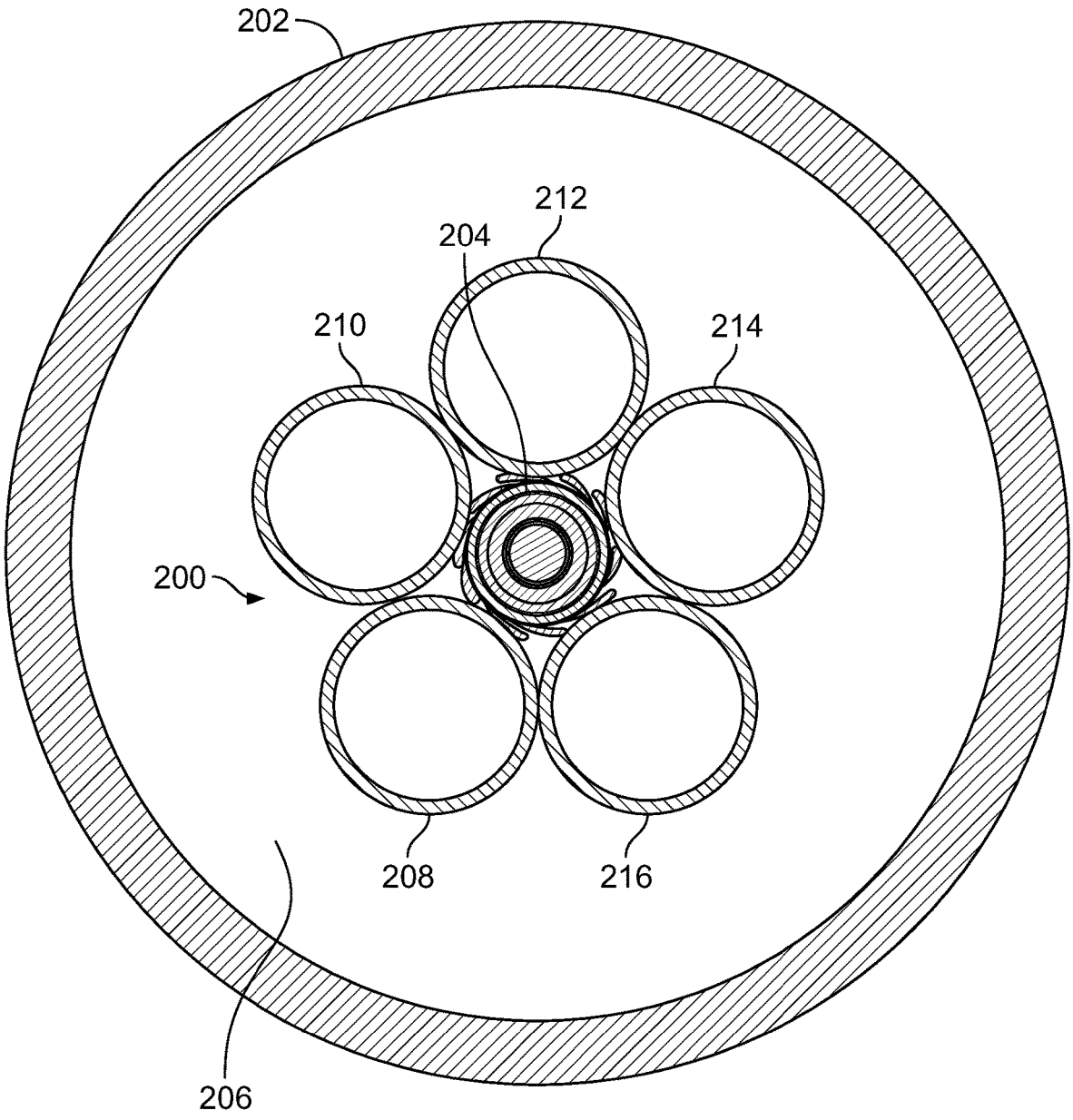
FIG. 2 depicts a cross section of a cluster of perforator guns in a closed position, according to some embodiments.

FIG. 2 depicts a cross section of a cluster of perforator guns in a closed position, according to some embodiments. FIG. 2 depicts a cross section of a cluster 200 within a casing 202 of a wellbore. With reference to FIG. 1, the cluster 200 may be part of the perforator tool 112 positioned in the wellbore 104. In some applications, the wellbore may or may not include casing. For example, 202 can be the surrounding subsurface formation instead of the casing around the wellbore. The cluster 200 includes perforator guns 208, 210, 212, 214, and 216. The number of perforator guns in a cluster can be less or more than the example of five depicted in FIG. 2. Each perforator gun can be within an individually sealed hollow carrier, wherein each perforator gun can include explosive shaped charges that are detonated during perforation, as further described below. Also, one or more similar clusters may be positioned above or below the cluster 200 in a perforator tool, as further described below.

As depicted in FIG. 2, the cluster 200 is in a closed position, which can be defined as a first axial position. While in the closed position, a fluid gap 206 is defined between the inner wall of the casing 202 and the perforator guns 208-216. A central member 204 can be in the center of the cluster 200. The central member 204 can include diametrically expandable tool to move the perforator guns 208-216 outward toward the casing 202 into an expanded position (a second axial position), as further described below. In some embodiments, the perforator guns 208-216 can be circumferentially positioned at a first equal angular spacing around the central member 204. While in the closed position, the perforator guns 208-216 can be near or in contact with the central member 204. Also, while in the closed position, each of the perforator guns 208-216 can be near or in contact with the two adjacent perforator guns. For example, the perforator gun 208 can be in contact with the perforator gun 210 and 216. The perforator guns 210 and 212 can be in contact with each other. The perforator guns 212 and 214 can be in contact with each other. The perforator guns 214 and 216 can be in contact with each other.

Figure 3:
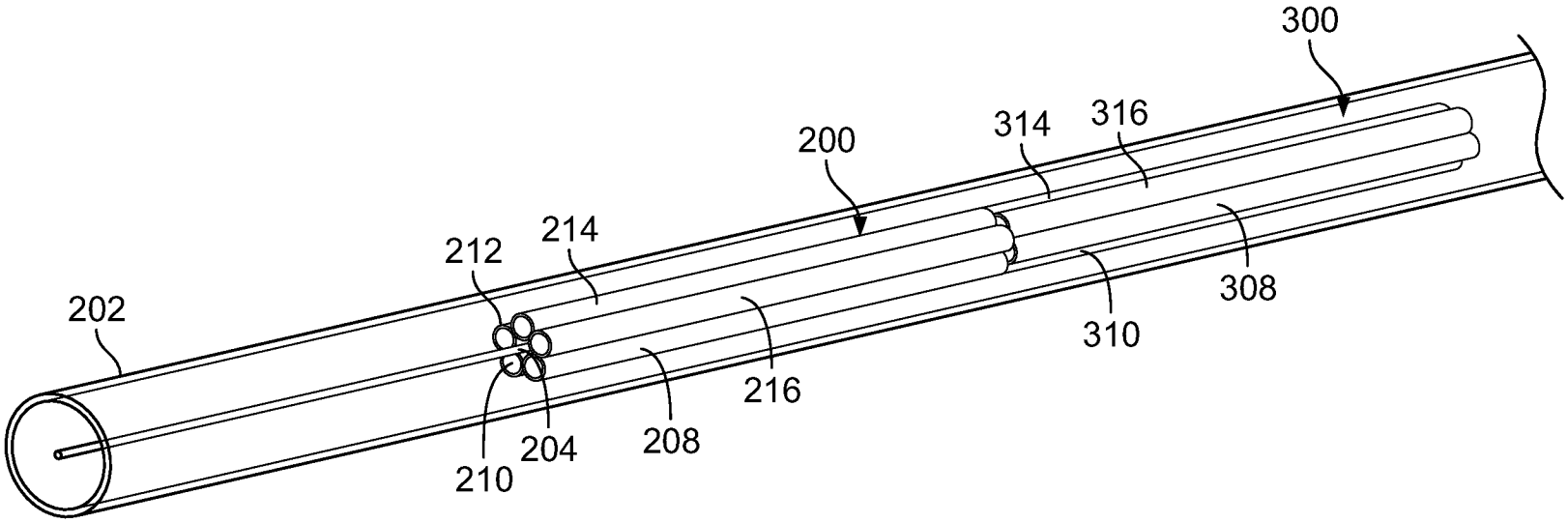
FIG. 3 depicts two clusters of perforator guns, wherein both clusters are in the closed position while being lowered into a wellbore, according to some embodiments.
Figure 6:
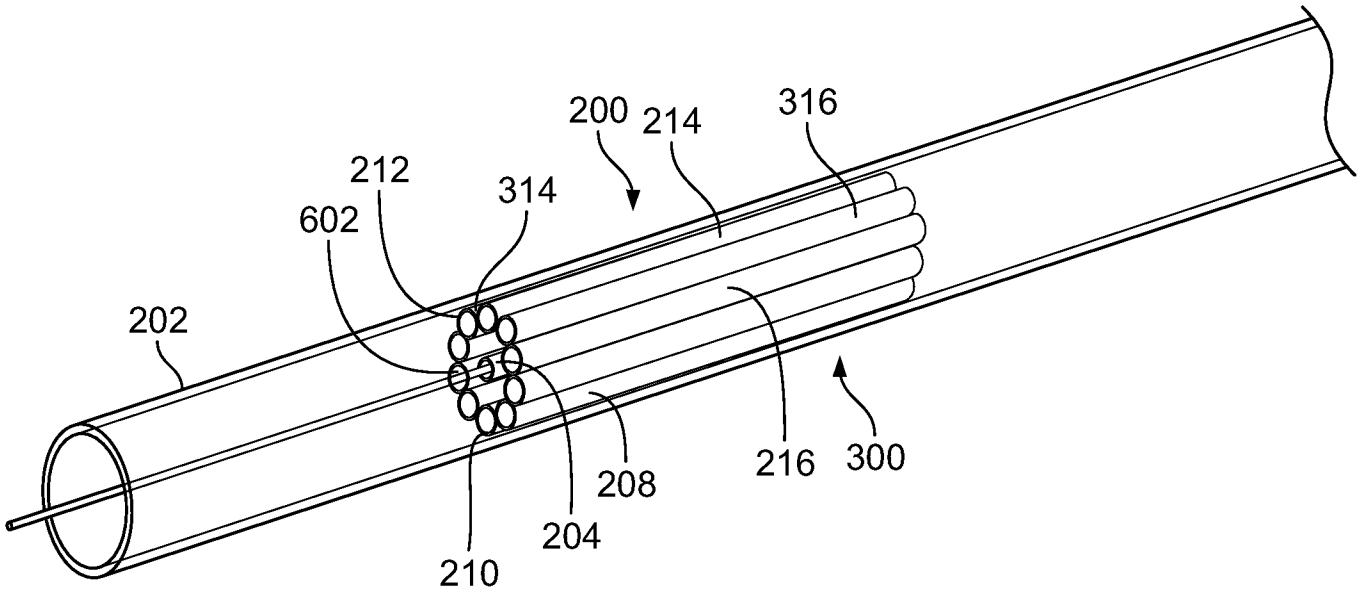
FIG. 6 depicts the two clusters of perforator guns in the wellbore, wherein both clusters remain in the expanded position and the first cluster is axially moved to at least partially overlap with the second cluster, according to some embodiments.
Figure 7:
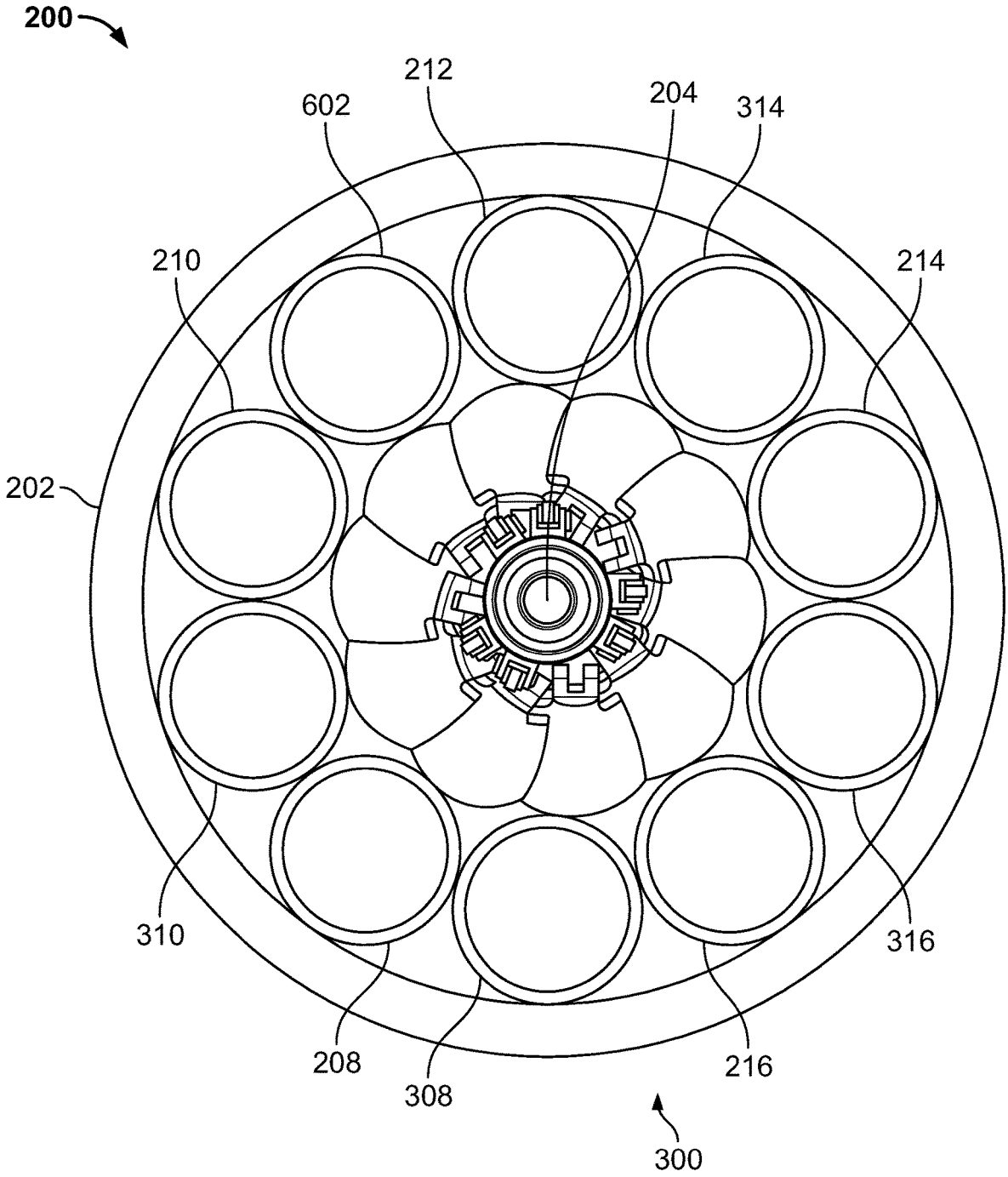
FIG. 7 depicts a cross section of the two clusters of perforator guns in the expanded position, according to some embodiments.

FIG. 3 depicts two clusters of perforator guns, wherein both clusters are in the closed position while being lowered into a wellbore, according to some embodiments. In this example, FIG. 3 depicts the cluster 200 and a cluster 300 positioned in the casino 202 of the wellbore. The clusters 200 and 300 are in two different axial positions along a central longitudinal axis of the central member 204. The cluster 200 is at a first axial position. The cluster 300 is at a second axial position. As described above, the cluster 200 includes five perforator guns 208-216. Similarly, the cluster 300 can also include five perforator guns. Because of the viewing angle, FIG. 3 only depicts four of the five perforator guns for the cluster 300—perforator guns 308, 310, 314, and 316. The fifth perforator gun for the cluster 300 is depicted in FIGS. 6-7 as a perforator gun 602, which is further described below. The perforator guns of the cluster 300 are in the closed position.

While in the closed position, the perforator guns in the cluster 300 can be near or in contact with the central member 204. Also, while in the closed position, each of the perforator guns of the cluster 300 can be near or in contact with the two adjacent perforator guns. For example, the perforator gun 308 can be in contact with the perforator gun 310 and 316. The perforator guns 310 and 602 (depicted in FIGS. 6-7) can be in contact with each other. The perforator guns 602 and 314 can be in contact with each other. The perforator guns 314 and 316 can be in contact with each other.

Each perforator gun in the cluster 300 can be within an individually sealed hollow carrier, wherein each perforator gun can include explosive shaped charges that are detonated during perforation, as further described below. In some embodiments, the perforator guns of the cluster 300 can be circumferentially positioned at the first equal angular spacing around the central member 204. Thus, the perforator guns in the cluster 200 and the perforator guns in the cluster 300 can have a same angular spacing. While having a same angular spacing, in some embodiments, the perforator guns in the cluster 300 have a phase offset to the perforator guns in the cluster 200. For example, the perforator guns in the cluster 300 can have an angular spacing with a phase offset of approximately one quarter to one half of the value of the angular spacing of the perforator guns in the cluster 200. With both clusters 200-300 being in a closed position, there is a fluid gap between each cluster and the wall of the wellbore.

In some embodiments, the perforator guns in the cluster 200 and the perforator guns in the cluster 300 can have different angular spacings. While depicted as having a same number of perforator guns in each cluster for this example, in some other embodiments, the number of perforator guns can vary between clusters. Additionally, while depicted as having two clusters in this example, in some other embodiments, there can be a greater number of clusters in the perforator tool, wherein each of the different clusters are positioned at different axial positions along the central member 204 in closed positions while the perforator tool is being lowered to the perforator position down the wellbore.

Figure 4:
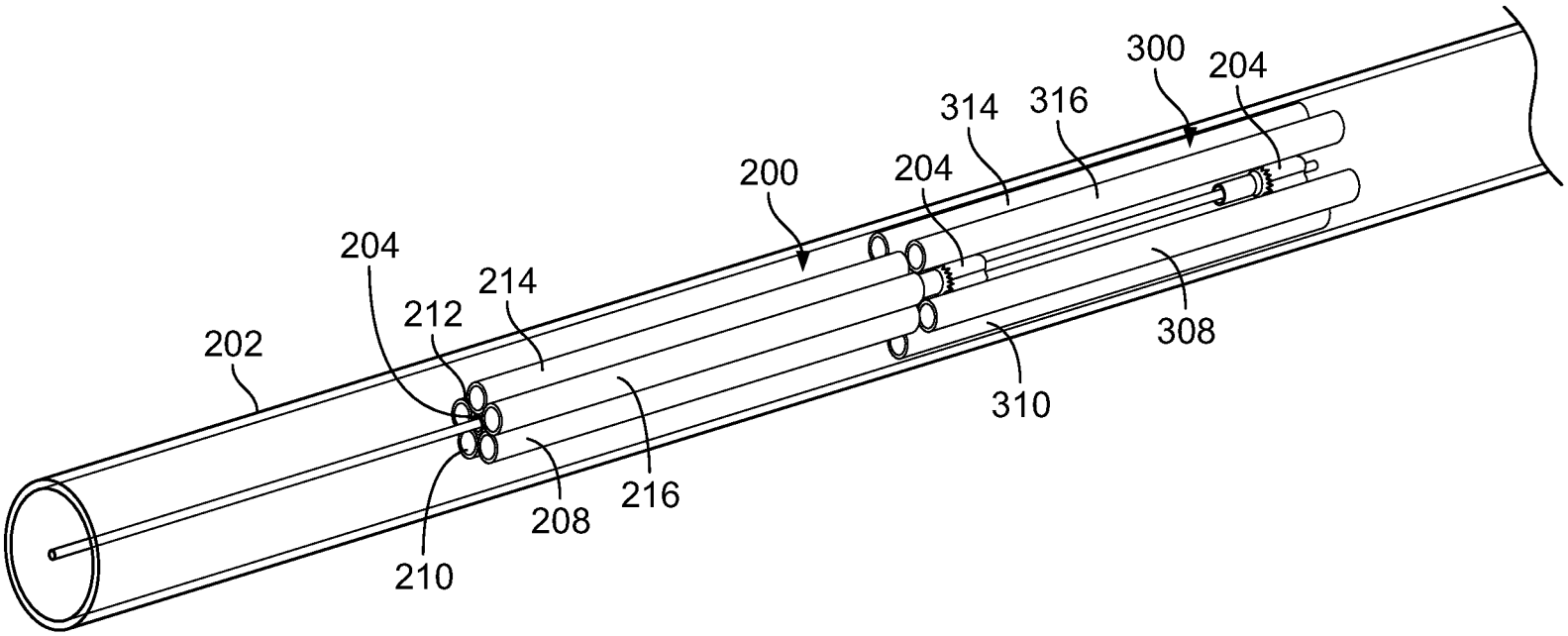
FIG. 4 depicts the two clusters of perforator guns in the wellbore, wherein the first cluster is in an expanded position and the second cluster remains in the closed position, according to some embodiments.

FIGS. 4-7 depict movements and positions of the clusters 200-300 after the perforator tool has been lowered to a positioned in the wellbore where perforation is to occur. FIG. 4 depicts the two clusters of perforator guns in the wellbore, wherein the first cluster is in an expanded position and the second cluster remains in the closed position, according to some embodiments. In this example, the perforator guns 208, 210, 212, 214, and 216 in the cluster 200 remain in the closed position.

However, the perforator guns 308, 310, 602, 314, and 316 in the cluster 300 are moved to a second radial position that can be defined as an expanded position. The perforator guns in the cluster 300 can be moved to the expanded position by articulating an expandable part of the central member 204 that is coupled to the perforator guns in the cluster 300. The expandable part of the central member 204 is depicted in FIG. 7, further described below. In the expanded position, the perforator guns 308, 310, 602, 314, and 316 can be near or in contact with the wall of the casino 202 of the wellbore.

Figure 5:
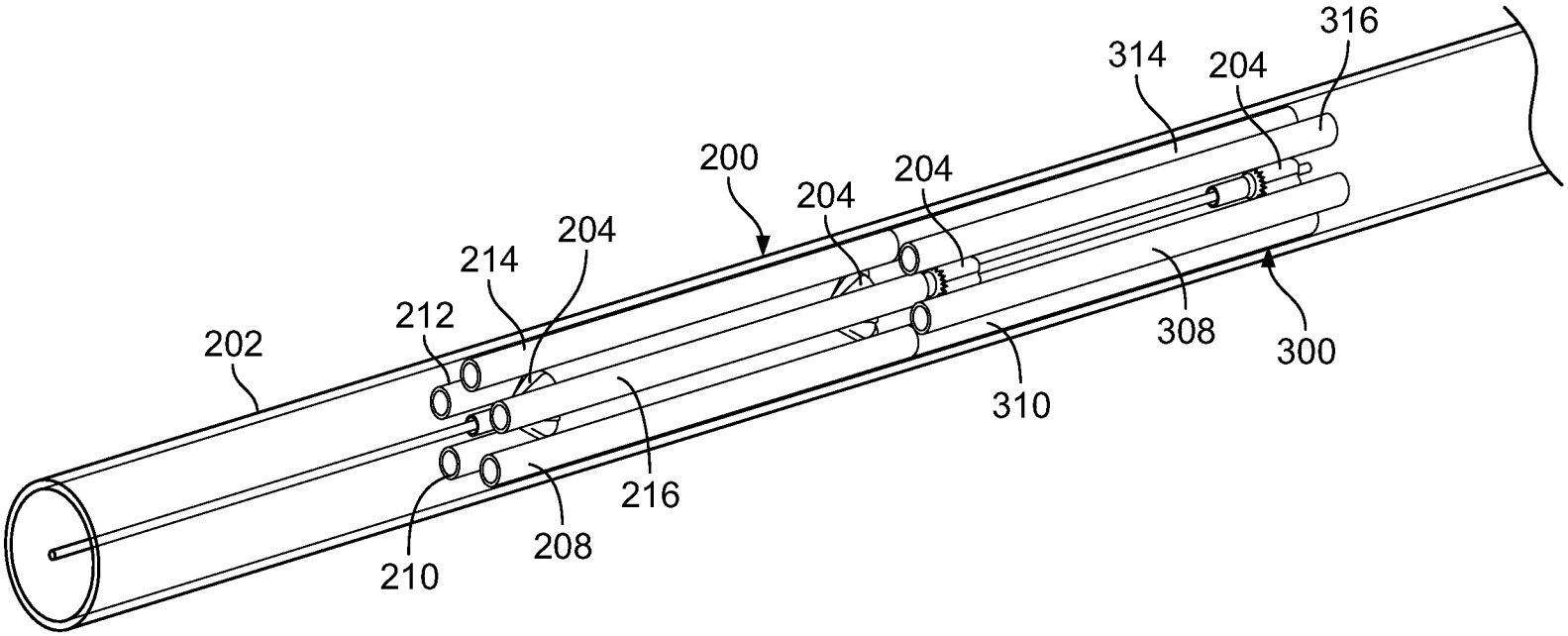
FIG. 5 depicts the two clusters of perforator guns in the wellbore, wherein both clusters are in the expanded position, according to some embodiments.

FIG. 5 depicts the two clusters of perforator guns in the wellbore, wherein both clusters are in the expanded position, according to some embodiments. The perforator guns 308, 310, 602, 314, and 316 in the cluster 300 remain in the expanded position.

The perforator guns 208, 210, 212, 214, and 216 in the cluster 200 are moved to the second radial position (the expanded position). The perforator guns in the cluster 200 can be moved to the expanded position by articulating an expandable part of the central member 204 that is coupled to the perforator guns in the cluster 200. In the expanded position, the perforator guns 208, 210, 212, 214, and 216 can be near or in contact with the wall of the casino 202 of the wellbore.

FIG. 6 depicts the two clusters of perforator guns in the wellbore, wherein both clusters remain in the expanded position and the first cluster is axially moved to at least partially overlap with the second cluster, according to some embodiments. In this example, the cluster 300 is moved to be in approximately a same axial position as the cluster 200. In some embodiments, the cluster 300 is moved to provide at least a partial overlap with the cluster 200. As shown, because the perforator guns of both clusters have been moved to an expanded position, there is space to allow for the clusters to overlap.

To further illustrate, FIG. 7 depicts a cross section of the two clusters of perforator guns in the expanded position, according to some embodiments. FIG. 7 depicts a cross section of the cluster 200 and the cluster 300 within the casing 202 of a wellbore. While in the expanded position, a fluid gap is essentially eliminated between the inner wall of the casing 202 and the perforator guns of the clusters 200-300. Also, the cluster 300 is now positioned axially to at least partially overlap with the cluster 200.

The central member 204 can be positioned in the center of the perforator guns for both the cluster 200 and the cluster 300. In contrast to the central member 204 in the closed position depicted in FIG. 2, the central member 204 in FIG. 7 has been moved to an expanded position to move the perforator guns for the clusters 200-300 into their expanded position near the casing 202.

After axial movement of the perforator guns in the cluster 300 to at least partially overlap with the perforator guns in the cluster 200, the perforator guns in the cluster 300 are interlaced with the perforator guns in the cluster 200. In this example, the perforator gun 208 is positioned adjacent to the perforator gun 310 and the perforator gun 308. The perforator gun 308 is adjacent to the perforator gun 216. The perforator gun 216 is adjacent to the perforator gun 316. The perforator gun 316 is adjacent to the perforator gun 214. The perforator gun 214 is adjacent to the perforator gun 314. The perforator gun 314 is adjacent to the perforator gun 212. The perforator gun 212 is adjacent to the perforator gun 602. The perforator gun 602 is adjacent to the perforator gun 210. The perforator gun 210 is adjacent to the perforator gun 310.

While in the expanded position, the perforator guns in the clusters 200-300 can be near or in contact with the casing 202. Also, while in the expanded position and interlaced, each of the perforator guns in the clusters 200-300 can be near or in contact with the two adjacent perforator guns. For example, the perforator gun 208 can be in contact with the perforator guns 310 and 308. The perforator guns 308 and 216 can be in contact with each other. The perforator guns 216 and 316 can be in contact with each other. The perforator guns 316 and 214 can be in contact with each other. The perforator guns 316 and 214 can be in contact with each other. The perforator guns 214 and 314 can be in contact with each other. The perforator guns 314 and 212 can be in contact with each other. The perforator guns 212 and 602 can be in contact with each other. The perforator guns 602 and 210 can be in contact with each other. The perforator guns 210 and 310 can be in contact with each other.

Accordingly, after the cluster 200 and the cluster 300 are overlapping, a denser perforator cluster is formed than either of the two clusters separately. Thus, multiple clusters of perforator guns can be in a small radial position while being lowered downhole to a perforator position. After reaching the perforator position, the perforator guns can then be expanded and overlapped to create an increased packing density.

Example Perforator Operations

Figure 8:
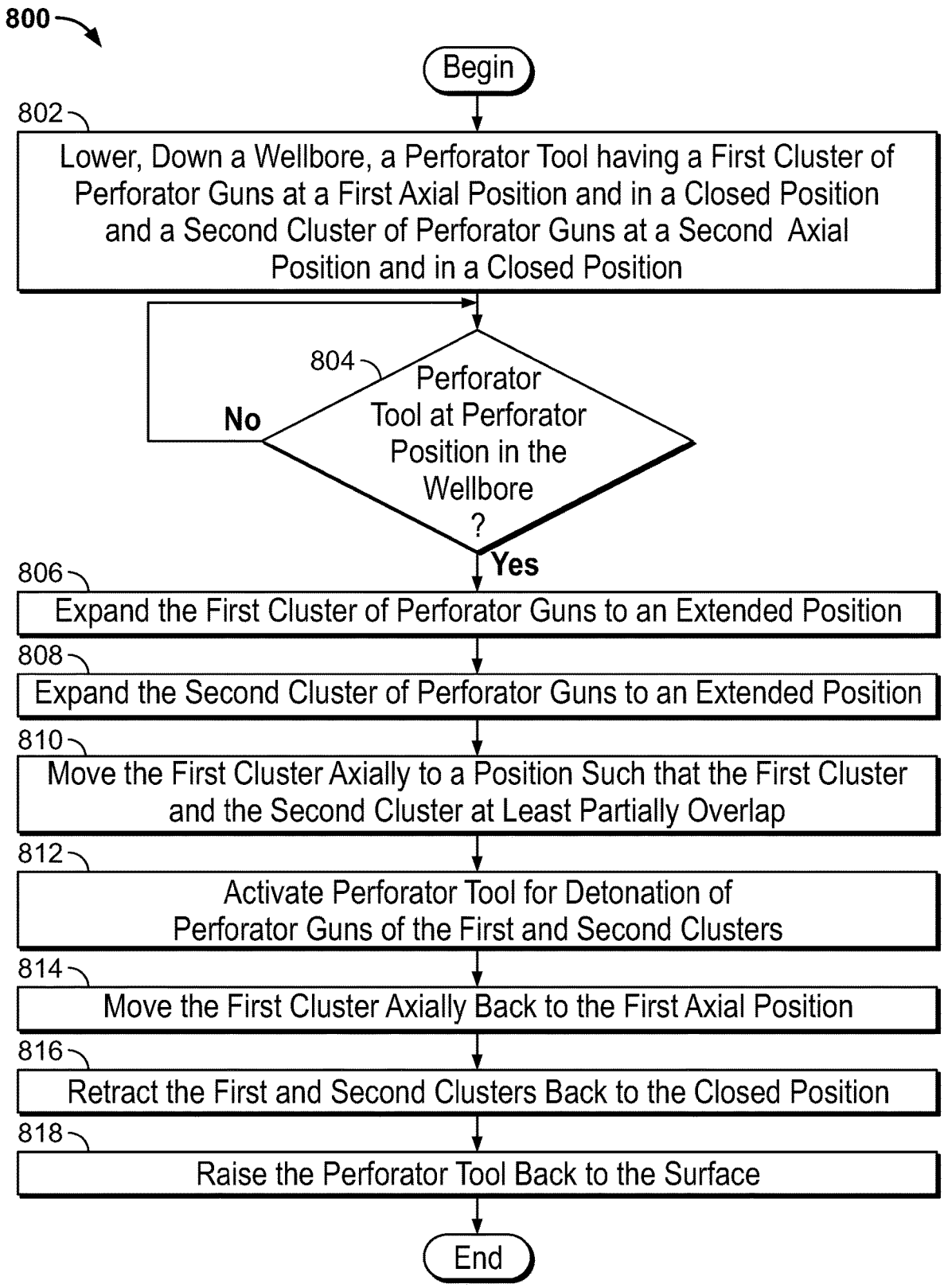
FIG. 8 depicts a flowchart for configuring at least two clusters of perforator guns for perforation in a wellbore, according to some embodiments.

FIG. 8 depicts a flowchart for configuring at least two clusters of perforator guns for perforation in a wellbore, according to some embodiments. At least some of the operations in a flowchart 800 of FIG. 8 can be performed based on execution of program code/instructions stored in one or more machine-readable media. For example, at least some of the operations can be performed via a programmable logic controller (PLC) with electronic actuators, a hydraulic logic using a series of pistons and orifices, mechanical movement of at least one portion of the central member 204 relative to another, and any other types of downhole manipulation methods.

A perforator tool having a first cluster of perforator guns and a second cluster of perforator guns is lowered down a wellbore (802). The first and second clusters of perforator guns are both in a closed position. The first cluster of perforator guns is at a first axial position. The second cluster of perforator guns is at a first axial position. With reference to FIG. 3, the cluster 200 and the cluster 300 in a perforator tool is lowered down the wellbore while in the closed position. Also, the cluster 200 and the cluster 300 can be at different axial positions such that there is no overlap. The perforator guns in the cluster 200 and the perforator guns in the cluster 300 can have a same angular spacing. While having a same angular spacing, in some embodiments, the perforator guns in the cluster 300 have a phase offset to the perforator guns in the cluster 200. For example, the perforator guns in the cluster 300 can have an angular spacing with a phase offset of approximately one quarter to one half of the value of the angular spacing of the perforator guns in the cluster 200.

A determination is made of whether the perforator tool has been lowered to a designated perforator position in the wellbore (804). Thus, the perforator tool continues to be lowered into the wellbore until the location is reached where a perforation is to occur. With reference to FIG. 1, the perforator tool 112 is lowered down the wellbore 104 until the designated perforator position has been reached. If the perforator tool has not yet been lowered to the designated perforator position, operations remain at 804. If the perforator tool has been lowered to the designated perforator position, operations continue at 806.

The first cluster of perforator guns is expanded from the closed position to an expanded position (806). With reference to FIG. 4, the perforator guns of the cluster 300 are expanded to the expanded position outwarded to be near or in contact with the casing 202.

The second cluster of perforator guns is expanded from the closed position to an expanded position (808). With reference to FIG. 5, the perforator guns of the cluster 200 are expanded to the expanded position outwarded to be near or in contact with the casing 202.

The first cluster is axially moved to a position such that the first cluster and the second cluster at least partially overlap (810). With reference to FIG. 6, the perforator guns of the cluster 300 are moved axially to at least partially overlap with the perforator guns of the cluster 200. As described above, the overlap can occur because of expanded positions and because the positions of the perforator guns of the cluster 300 are at a phase offset relative to the positions of the perforator guns of the cluster 200. As depicted in FIG. 6, the perforator guns of the cluster 300 and the perforator guns of the cluster 200 can be at approximately same axial position.

The perforator tool is activated for detonation of the perforator guns of the first and second clusters to create holes in the casing, the surrounding formation, etc. (812). Each perforator gun can include one or more explosive charges that may be triggered to detonate, perforating a casing, if present, a wall of the wellbore, forming perforation tunnels in the subterranean formation, etc.

After perforation, the first cluster is moved axially back to the first axial position (814). With reference to FIGS. 5-6, the cluster 300 can be moved from its position depicted in FIG. 6 to its position depicted in FIG. 5, thereby removing the overlap between the two clusters.

The first and second clusters can then be retracted back to the closed position (816). With reference to FIGS. 3-4, the clusters 300 and 200 can be retracted back from the expanded position to the closed position.

The perforator tool is raised to the surface (818). With reference to FIG. 1, the perforator tool 112 can be moved back up the wellbore 104 to the surface.

In some situations, after detonation, the clusters can be significantly damaged, fragmented, dissolved away, etc. In these situations, the central member 204 of the perforator tool can be retrieved or dropped. Accordingly, the operations at 814-816 are not needed.

The flowchart is provided to aid in understanding the illustrations and are not to be used to limit scope of the claims. The flowchart depicts example operations that can vary within the scope of the claims. Additional operations may be performed; fewer operations may be performed; the operations may be performed in parallel; and the operations may be performed in a different order. For example, the operations depicted in blocks 806 and 808 can be performed in parallel or concurrently.

Example Computer

Figure 9:
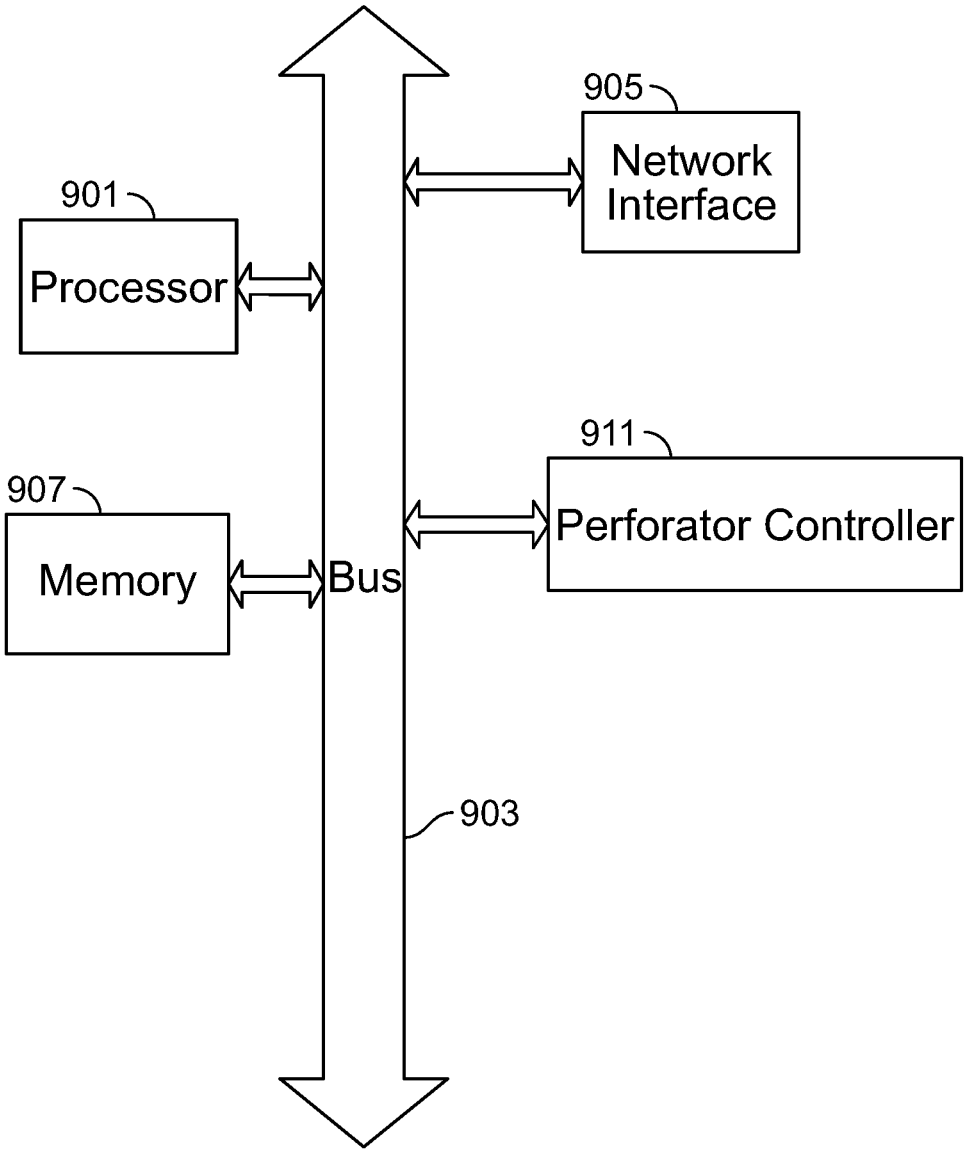
FIG. 9 depicts an example computer system, according to some embodiments.

FIG. 9 depicts an example computer system, according to some embodiments. The computer system includes a processor 901 (possibly including multiple processors, multiple cores, multiple nodes, and/or implementing multi-threading, etc.). The computer system includes memory 907. The memory 907 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 903 (e.g., PCI, ISA, PCI-Express, HyperTransport® bus, InfiniBand® bus, NuBus, etc.) and a network interface 905 (e.g., a Fiber Channel interface, an Ethernet interface, an internet small computer system interface, SONET interface, wireless interface, etc.).

The computer system also includes a perforator controller 911. The perforator controller 911 can perform one or more operations for controller a perforator tool (as described above). Any one of the previously described functionalities may be partially (or entirely) implemented in hardware and/or on the processor 901. For example, the functionality may be implemented with an application specific integrated circuit, in logic implemented in the processor 901, in a co-processor on a peripheral device or card, etc. Further, realizations may include fewer or additional components not illustrated in FIG. 9 (e.g., video cards, audio cards, additional network interfaces, peripheral devices, etc.). The processor 901 and the network interface 905 are coupled to the bus 903. Although illustrated as being coupled to the bus 903, the memory 907 may be coupled to the processor 901.

It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for perforation as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

In some embodiments, an apparatus comprises a first cluster of perforator guns positioned circumferentially around a central longitudinal axis at a first axial position. The apparatus includes a second cluster of perforator guns positioned circumferentially around the central longitudinal axis at a second axial position. The first and second clusters are configured in a closed position while the apparatus is being lowered to a perforator position in a wellbore. After the apparatus is lowered to the perforator position, the first and second clusters are to move to an expanded position and the first cluster is to move axially such that the first cluster and the second cluster at least partially overlap.

In some embodiments, the perforator guns of the first cluster are at a phase offset relative to the perforator guns of the second cluster in the closed position.

In some embodiments, the perforator guns of the first cluster and the second cluster are at an essentially equal angular spacing in the closed position.

In some embodiments, the first cluster and the second cluster are axially non-overlapping while the apparatus is being lowered to the perforator position in the wellbore.

In some embodiments, each perforator gun of the first and second clusters includes an explosive charge to be detonated.

In some embodiments, the apparatus includes a central member positioned along the central longitudinal axis, wherein the perforator guns of the first cluster and the perforator guns of the second cluster are in contact with the central member while in the closed position.

In some embodiments, in the first cluster, each perforator gun is in contact with at least one other perforator gun while in the closed position. Also, in the second cluster, each perforator gun is in contact with at least one other perforator gun while in the closed position.

In some embodiments, the first cluster is to move axially such that the first cluster and the second cluster at least partially overlap prior to perforation of the wellbore based on detonation of the first and second clusters of perforator guns.

In some embodiments, the perforator guns of the first and second clusters are to detonate to perforate at least one of a casing of the wellbore and a surrounding formation.

In some embodiments, after the apparatus is lowered to the perforator position, the first cluster is to move axially such that the first cluster and the second cluster are at essentially a same axial position.

In some embodiments, an apparatus includes a perforator tool having a central longitudinal axis for placement in a wellbore extending through a subterranean formation. The perforator tool includes a central member positioned along the central longitudinal axis. The perforator tool also includes a first cluster of perforator guns positioned circumferentially around the central longitudinal axis and at a first axial position. The perforator tool includes a second cluster of perforator guns positioned circumferentially around the central longitudinal axis. The first and second perforating guns have explosive charges to perforate at least one of a downhole tubular in the wellbore and the subterranean formation. The first and second clusters are to circumscribe a first radial position until the perforator tool is lowered down the wellbore to a perforator position. After the perforator tool is lowered to the perforating position, the first and second clusters of perforator guns are to expand to a second radial position having a diameter that is larger than the first radial position and the first cluster is to axially move such that the first cluster and the second cluster at least partially overlap prior to the perforation.

In some embodiments, the perforator guns of the first cluster and the perforator guns of the second cluster are in contact with the central member while in the first axial position.

In some embodiments, in the first cluster, each perforator gun is in contact with at least one other perforator gun while in the first axial position. In the second cluster, each perforator gun is in contact with at least one other perforator gun while in the first axial position.

In some embodiments, the perforator guns of the first cluster are at a phase offset relative to the perforator guns of the second cluster in the first axial position.

In some embodiments, the perforator guns of the first cluster and the second cluster are at an essentially equal angular spacing in the first axial position.

In some embodiments, the first cluster and the second cluster are axially non-overlapping while the apparatus is being lowered to the perforator position in the wellbore.

In some embodiments, a method includes lowering a perforator tool down a wellbore to a perforating position, wherein the perforator tool comprises a first cluster of perforator guns in a closed position at a first axial position and a second cluster of perforator guns in the closed position at a second axial position. The method includes, in response to the perforator lowered to a perforator position in the wellbore, moving the first cluster of perforator guns from the closed position to an expanded position and moving the second cluster of perforator guns from the closed position to the expanded position. The method also includes, in response to the perforator lowered to a perforator position in the wellbore, moving the first cluster axially such that the first cluster and the second cluster at least partially overlap and perforating the wellbore based on detonation of the first and second cluster of perforator guns.

In some embodiments, the perforator guns of the first cluster are at a phase offset relative to the perforator guns of the second cluster in the closed position.

In some embodiments, a central member is positioned along a central longitudinal axis for the perforator tool, wherein the perforator guns of the first cluster and the perforator guns of the second cluster are in contact with the central member while in the closed position.

In some embodiments, in the first cluster, each perforator gun is in contact with at least one other perforator gun while in the closed position. In the second cluster, each perforator gun is in contact with at least one other perforator gun while in the closed position.

Additional embodiments can include varying combinations of features or elements from the example embodiments described above. For example, one embodiment may include elements from three of the example embodiments while another embodiment includes elements from five of the example embodiments described above.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

What is claimed is:

1. An apparatus comprising:

a first cluster of perforator guns positioned circumferentially around a central longitudinal axis at a first axial position; and a second cluster of perforator guns positioned circumferentially around the central longitudinal axis at a second axial position, wherein the first and second clusters are configured in a closed position while the apparatus is being lowered to a perforator position in a wellbore, wherein, after the apparatus is lowered to the perforator position, the first and second clusters are configured to move to an expanded position and the first cluster is configured to move axially such that the first cluster and the second cluster at least partially overlap.

2. The apparatus of claim 1, wherein the perforator guns of the first cluster are at a phase offset relative to the perforator guns of the second cluster in the closed position.

3. The apparatus of claim 2, wherein the perforator guns of the first cluster and the second cluster are at an essentially equal angular spacing in the closed position.

4. The apparatus of claim 1, wherein the first cluster and the second cluster are axially non-overlapping while the apparatus is being lowered to the perforator position in the wellbore.

5. The apparatus of claim 1, wherein each perforator gun of the first and second clusters includes an explosive charge to be detonated.

6. The apparatus of claim 1, further comprising a central member positioned along the central longitudinal axis, wherein the perforator guns of the first cluster and the perforator guns of the second cluster are in contact with the central member while in the closed position.

7. The apparatus of claim 6, wherein, in the first cluster, each perforator gun is in contact with at least one other perforator gun while in the closed position, and wherein, in the second cluster, each perforator gun is in contact with at least one other perforator gun while in the closed position.

8. The apparatus of claim 1, wherein the first cluster is configured to move axially such that the first cluster and the second cluster at least partially overlap prior to perforation of the wellbore based on detonation of the first and second clusters of perforator guns.

9. The apparatus of claim 1, wherein the perforator guns of the first and second clusters are configured to detonate to perforate at least one of a casing of the wellbore and a surrounding formation.

10. The apparatus of claim 1, wherein, after the apparatus is lowered to the perforator position, the first cluster is configured to move axially such that the first cluster and the second cluster are at essentially a same axial position.

11. An apparatus comprising:

a perforator tool having a central longitudinal axis for placement in a wellbore extending through a subterranean formation, the perforator tool comprising, a central member positioned along the central longitudinal axis;

a first cluster of perforator guns positioned circumferentially around the central longitudinal axis and at a first axial position; and a second cluster of perforator guns positioned circumferentially around the central longitudinal axis, the first and second clusters of perforating guns having explosive charges to perforate at least one of a downhole tubular in the wellbore and the subterranean formation, wherein the first and second clusters are configured to circumscribe a first radial position until the perforator tool is lowered down the wellbore to a perforator position, wherein, after the perforator tool is lowered to the perforating position, the first and second clusters of perforator guns are configured to expand to a second radial position having a diameter that is larger than the first radial position and the first cluster is configured to axially move such that the first cluster and the second cluster at least partially overlap prior to a perforation.

12. The apparatus of claim 11, wherein the perforator guns of the first cluster and the perforator guns of the second cluster are in contact with the central member while in the first axial position.

13. The apparatus of claim 12, wherein, in the first cluster, each perforator gun is in contact with at least one other perforator gun while in the first axial position, and wherein, in the second cluster, each perforator gun is in contact with at least one other perforator gun while in the first axial position.

14. The apparatus of claim 11, wherein the perforator guns of the first cluster are at a phase offset relative to the perforator guns of the second cluster in the first axial position.

15. The apparatus of claim 14, wherein the perforator guns of the first cluster and the second cluster are at an essentially equal angular spacing in the first axial position.

16. The apparatus of claim 11, wherein the first cluster and the second cluster are axially non-overlapping while the apparatus is being lowered to the perforator position in the wellbore.

17. A method comprising:

lowering a perforator tool down a wellbore to a perforating position, wherein the perforator tool comprises a first cluster of perforator guns in a closed position at a first axial position and a second cluster of perforator guns in the closed position at a second axial position; and in response to the perforator tool being lowered to a perforator position in the wellbore, moving the first cluster of perforator guns from the closed position to an expanded position;

moving the second cluster of perforator guns from the closed position to the expanded position;

moving the first cluster axially such that the first cluster and the second cluster at least partially overlap; and perforating the wellbore based on detonation of the first and second cluster of perforator guns.

18. The method of claim 17, wherein the perforator guns of the first cluster are at a phase offset relative to the perforator guns of the second cluster in the closed position.

19. The method of claim 17, wherein a central member is positioned along a central longitudinal axis for the perforator tool, wherein the perforator guns of the first cluster and the perforator guns of the second cluster are in contact with the central member while in the closed position.

20. The method of claim 19, wherein, in the first cluster, each perforator gun is in contact with at least one other perforator gun while in the closed position, and wherein, in the second cluster, each perforator gun is in contact with at least one other perforator gun while in the closed position.

* * * * *